US010413057B2

(12) United States Patent
McLean

(10) Patent No.: US 10,413,057 B2
(45) Date of Patent: Sep. 17, 2019

(54) THREAD STORAGE SYSTEM

(71) Applicant: Bessie McLean, Fairmont, NC (US)

(72) Inventor: Bessie McLean, Fairmont, NC (US)

( * ) Notice: Subject to any disclaimer, the term of this patent is extended or adjusted under 35 U.S.C. 154(b) by 0 days.

(21) Appl. No.: 15/815,929

(22) Filed: Nov. 17, 2017

(65) Prior Publication Data

US 2019/0150614 A1 May 23, 2019

(51) Int. Cl.
*A47B 81/00* (2006.01)
*A47B 49/00* (2006.01)
(Continued)

(52) U.S. Cl.
CPC ..... *A47B 81/00* (2013.01); *A47B 49/00* (2013.01); *A47B 81/007* (2013.01); *A47B 87/0276* (2013.01); *A47B 87/0292* (2013.01); *A47B 96/02* (2013.01); *B65D 85/04* (2013.01); *B65H 49/322* (2013.01); *D05B 91/16* (2013.01); *A47F 7/17* (2013.01)

(58) Field of Classification Search
CPC ..... A47B 81/00; A47B 96/02; A47B 49/00; A47B 96/04; A47B 47/0091; A47B 2230/0085; A47B 47/042; A47B 47/0075; A47B 2230/0092; A47B 47/00; A47B 47/047; A47B 96/145; A47B 57/10; A47B 81/068; A47B 47/06; A47B 47/0058; A47B 87/00; A47B 87/007; A47B 96/00; A47B 87/0276; A47B 87/0284; A47B 87/0292; A47B 87/0207; A47B 81/007; A47F 5/0018; A47F 5/0025; A47F 5/0043; A47F 5/10; A47F 5/101; A47F 5/11; A47F 5/112; A47F 5/116; A47F 7/17; A47F 7/005; A47F 81/007; B65D 85/04; D05B 91/16; B65H 49/205; B65H 49/322; B65H 49/32; B65H 57/04; B65H 57/16; B65H 2402/412
USPC ..... 211/184, 186, 189, 134, 135, 188; 108/60; 312/111, 198, 118, 128, 42, 45, 312/72; 206/561, 574, 39, 409; 220/524; 112/302, 254; 242/588.2, 137.1, 140, 242/594.4
See application file for complete search history.

(56) References Cited

U.S. PATENT DOCUMENTS 107,786 A 9/1870 Beck
437,688 A 10/1890 Good
(Continued)

FOREIGN PATENT DOCUMENTS

WO 2012074688 6/2012

*Primary Examiner* — Hiwot E Tefera

(57) ABSTRACT

A thread storage system including a housing that has a rear wall and a perimeter wall attached thereto. The perimeter wall includes a top wall and a bottom wall. A front side of the housing is open. A plurality of vertical walls extends between the top and bottom walls. A plurality of horizontal walls is attached to the vertical walls and the vertical and horizontal walls forms a plurality of compartments. Each of the compartments includes a pair of lateral walls, an upper wall and a lower wall. Each of plurality of doors has an upper edge, a lower edge, a first lateral edge and a second lateral edge. The compartments each has one of the doors is pivotally coupled thereto to allow selective closing of the compartments. Spools of thread are positionable in each of the compartments for storage and transporting purposes.

7 Claims, 6 Drawing Sheets

(51) Int. Cl.

| | |
|---|---|
| ***A47B 96/02*** | (2006.01) |
| ***A47B 87/02*** | (2006.01) |
| ***B65D 85/04*** | (2006.01) |
| ***D05B 91/16*** | (2006.01) |
| ***B65H 49/32*** | (2006.01) |
| *A47F 7/17* | (2006.01) |

(56) References Cited

U.S. PATENT DOCUMENTS

| | | | | | |
|---|---|---|---|---|---|
| 718,804 | A | | 1/1903 | Watson | |
| 820,596 | A | | 5/1906 | Norwood | |
| 1,946,276 | A | | 1/1932 | Castro-Barberena | |
| 2,234,233 | A | | 3/1940 | Corey | |
| 2,489,988 | A | * | 11/1949 | Taylor | A47F 7/17 242/139 |
| 2,588,529 | A | * | 3/1952 | Hume | B65H 49/16 211/85.5 |
| 3,093,277 | A | | 6/1963 | Mann | |
| 4,055,373 | A | * | 10/1977 | Andresen | A47B 47/047 108/61 |
| RE30,751 | E | * | 9/1981 | Castelli | A45C 11/00 220/524 |
| 5,170,892 | A | * | 12/1992 | Fromkin | A47B 47/00 211/184 |
| D374,119 | S | | 10/1996 | Noe | |
| 6,732,858 | B1 | * | 5/2004 | Chang Ou | A47B 87/0276 206/278 |
| 6,776,283 | B1 | * | 8/2004 | Drexler | B65D 25/105 206/391 |
| 7,000,868 | B1 | * | 2/2006 | Moore | B65H 49/32 112/254 |
| 8,016,222 | B2 | * | 9/2011 | Galgano | B62B 1/14 242/403 |
| 8,596,487 | B1 | * | 12/2013 | Su | B25H 3/06 206/486 |
| 2002/0175166 | A1 | * | 11/2002 | Robinson | A47B 47/0091 220/500 |
| 2006/0266723 | A1 | * | 11/2006 | Nickerson | A47B 81/007 211/94.01 |
| 2011/0147249 | A1 | * | 6/2011 | Huffman | B65D 5/0254 206/395 |
| 2017/0055706 | A1 | * | 3/2017 | Mataxis | A47B 87/0292 |

* cited by examiner

THREAD STORAGE SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art Including Information Disclosed Under 37 CFR 1.97 and 1.98

The disclosure and prior art relates to thread storing devices and more particularly pertains to a new thread storing device for storing and displaying a plurality of spools of thread to organize and facilitate access to the spools of thread.

BRIEF SUMMARY OF THE INVENTION

An embodiment of the disclosure meets the needs presented above by generally comprising a housing that has a rear wall and a perimeter wall attached to and extending forwardly of the rear wall. The perimeter wall includes a top wall and a bottom wall. A front side of the housing is open. A plurality of vertical walls extends between the top and bottom walls. The vertical walls are orientated parallel to each other. A plurality of horizontal walls is attached to the vertical walls and the vertical and horizontal walls forms a plurality of compartments. Each of the compartments includes a pair of lateral walls, an upper wall and a lower wall. Each of plurality of doors has an upper edge, a lower edge, a first lateral edge and a second lateral edge. The compartments each has one of the doors is pivotally coupled thereto to allow selective closing of the compartments. Spools of thread are positionable in each of the compartments for storage and transporting purposes.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
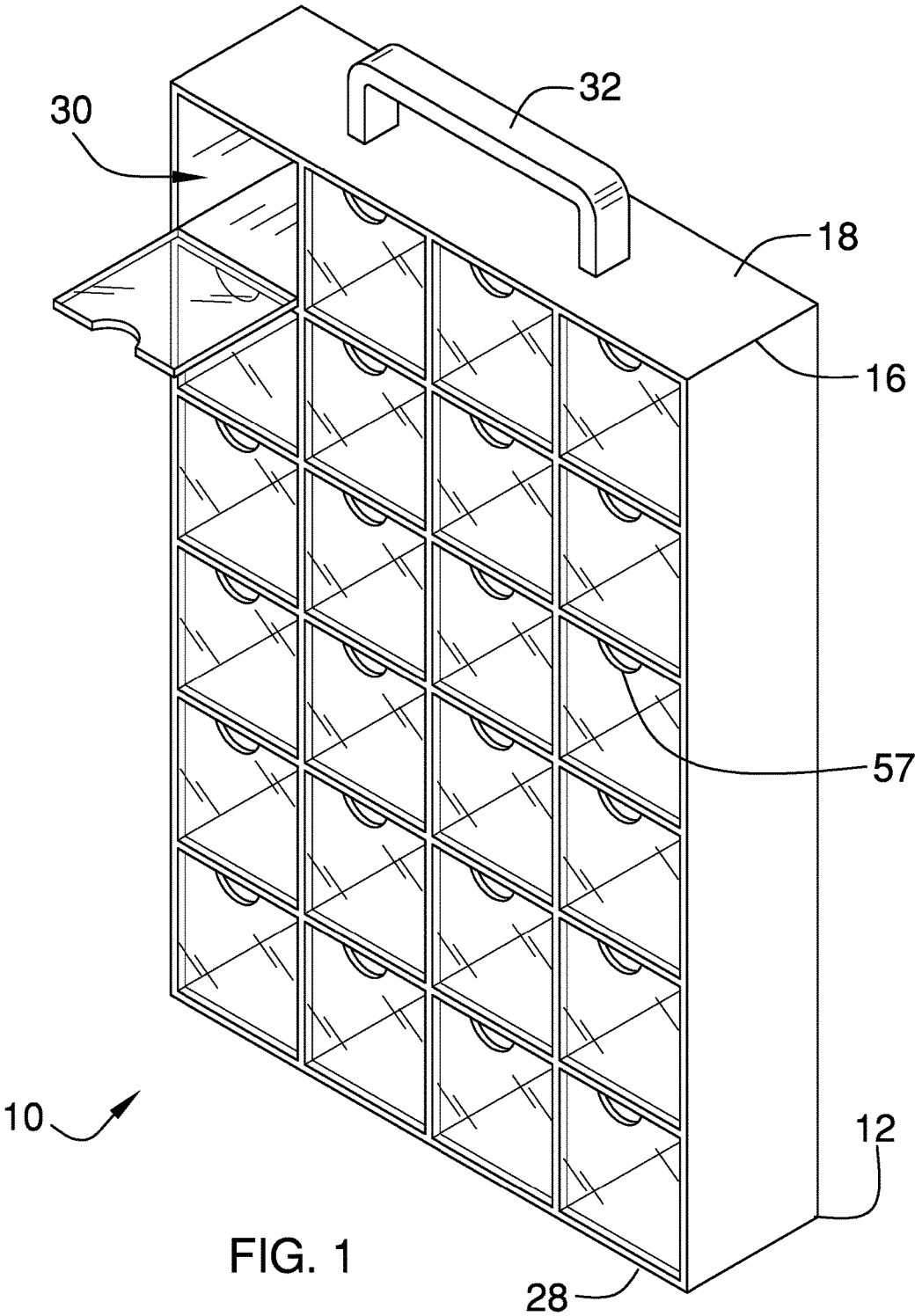
FIG. 1 is a front perspective view of a thread storage system according to an embodiment of the disclosure.

With reference now to the drawings, and in particular to FIGS. 1 through 6 thereof, a new thread storing device embodying the principles and concepts of an embodiment of the disclosure and generally designated by the reference numeral 10 will be described.

As best illustrated in FIGS. 1 through 6, the thread storage system 10 generally comprises a housing 12 having a rear wall 14 and a perimeter wall 16 that is attached to and extends forwardly of the rear wall 14. The perimeter wall 16 includes a top wall 18 and a bottom wall 20. A front side 22 of the housing 12 is open to allow access into an interior of the housing 12. A plurality of vertical walls 24 extends between the top 18 and bottom 20 walls and the vertical walls 24 are orientated parallel to each other. A plurality of horizontal walls 26 is attached to the vertical walls 24. Each of the horizontal 26 and vertical 24 walls extend from a front edge 28 of the perimeter wall 16 to the rear wall 14 so that the vertical 24 and horizontal 26 walls form a plurality of compartments 30. Also, the vertical 24 and horizontal 26 walls may each be continuously coupled to the rear wall 14 such that each compartment 30 is sealed from adjacent compartments 30 and the rear 14, perimeter 16, horizontal 26 and vertical 24 walls form a single, unitary structure which may be comprised of a plastic or other rigid material. A handle 32 may be attached to and extending upwardly from the top wall 18.

Each of the compartments 30 individually includes a pair of lateral walls 34, an upper wall 36 and a lower wall 38 to bound, along with the rear wall 14, what is defined as a thread receiving space. The compartments 30 each have a height between 1.25 inches and 2.5 inches, a width between 1.25 inches and 2.0 inches and a depth between 1.25 inches and 2.0 inches such that they are sized to only hold a single spool 70 of thread. The compartments 30 are arranged in columns and rows wherein the rows include at least five rows and the columns include at least four columns.

Figure 2:
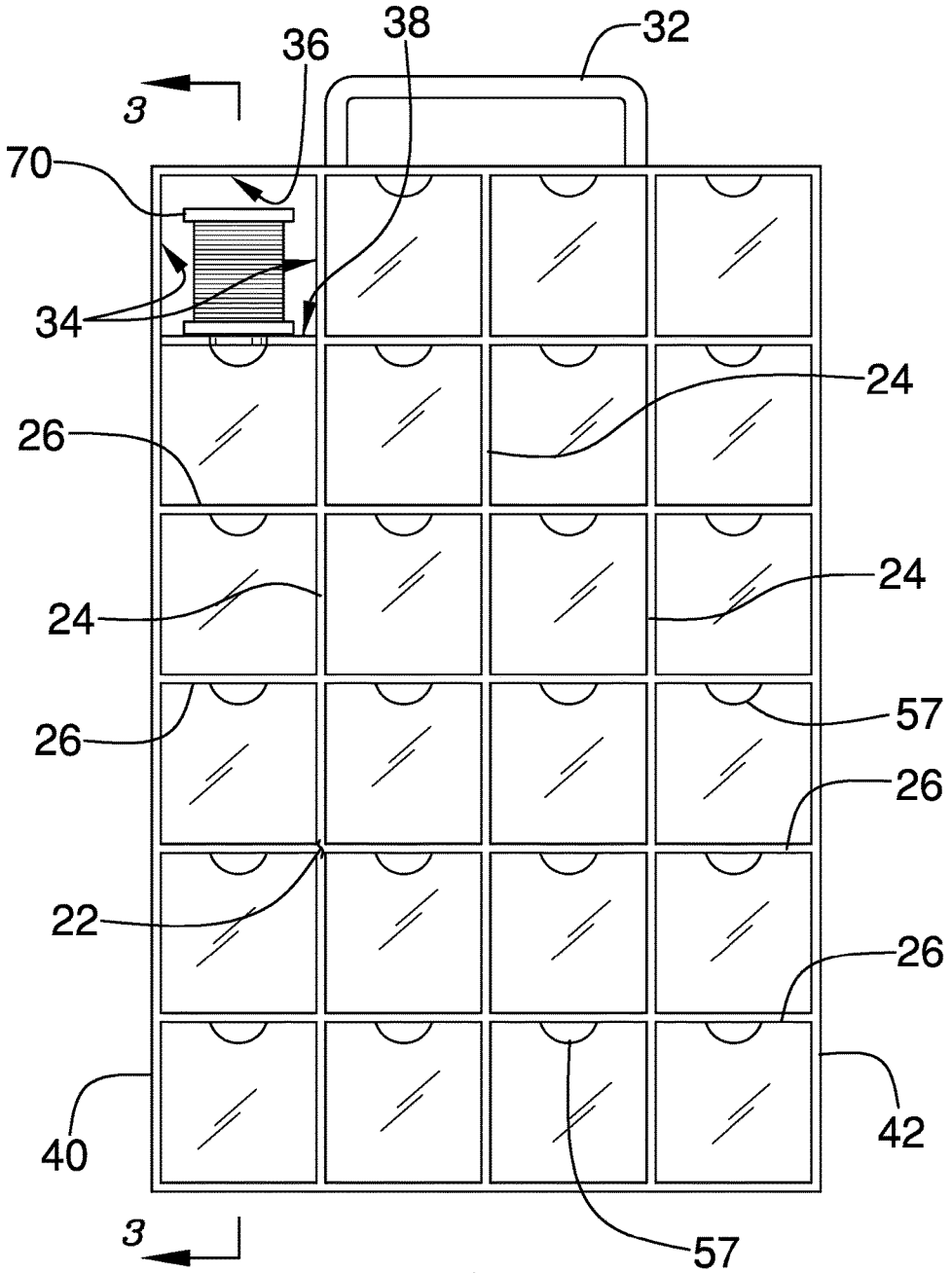
FIG. 2 is a front view of an embodiment of the disclosure.
Figure 3:
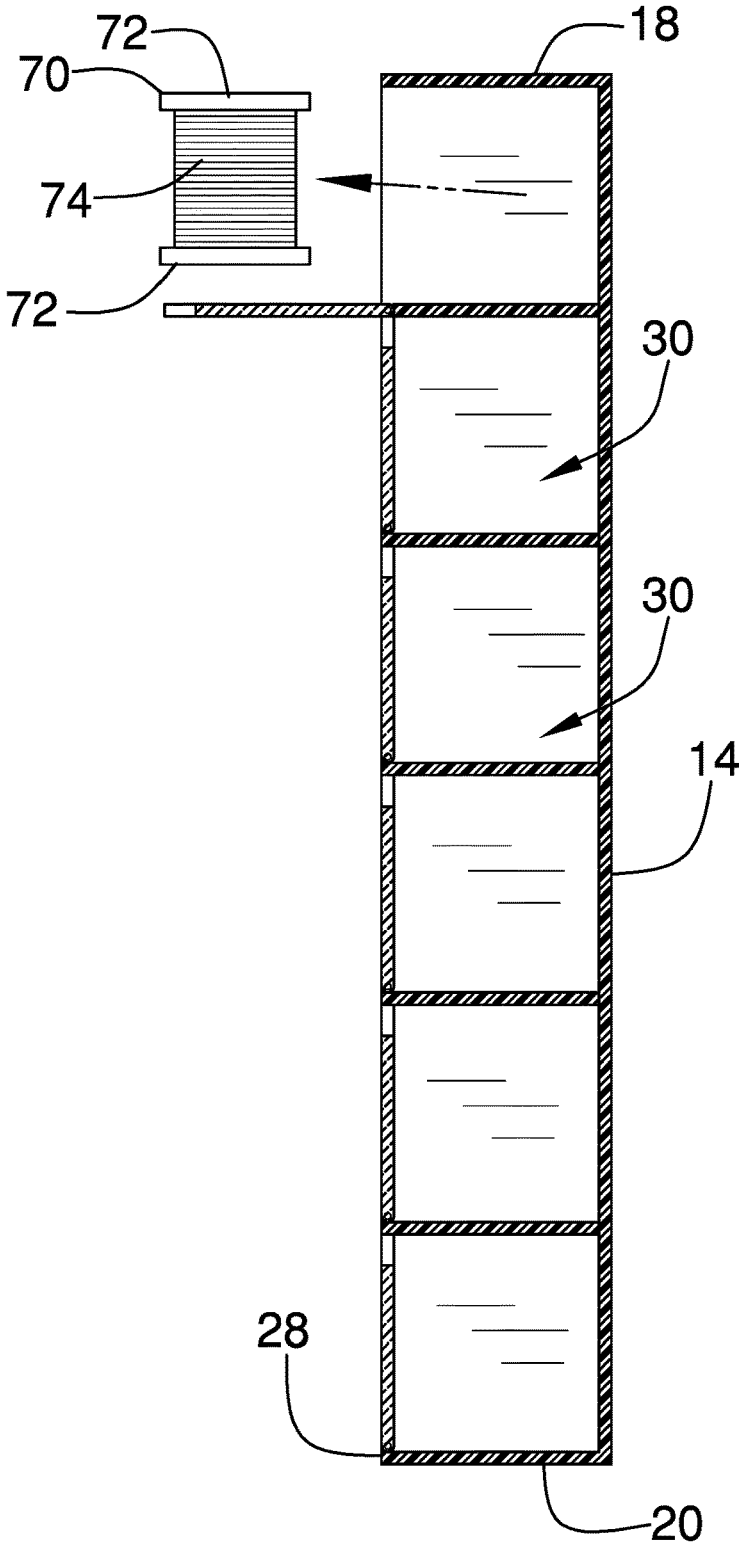
FIG. 3 is a cross-sectional view of an embodiment of the disclosure taken along line 3-3 of FIG. 2.
Figure 5:
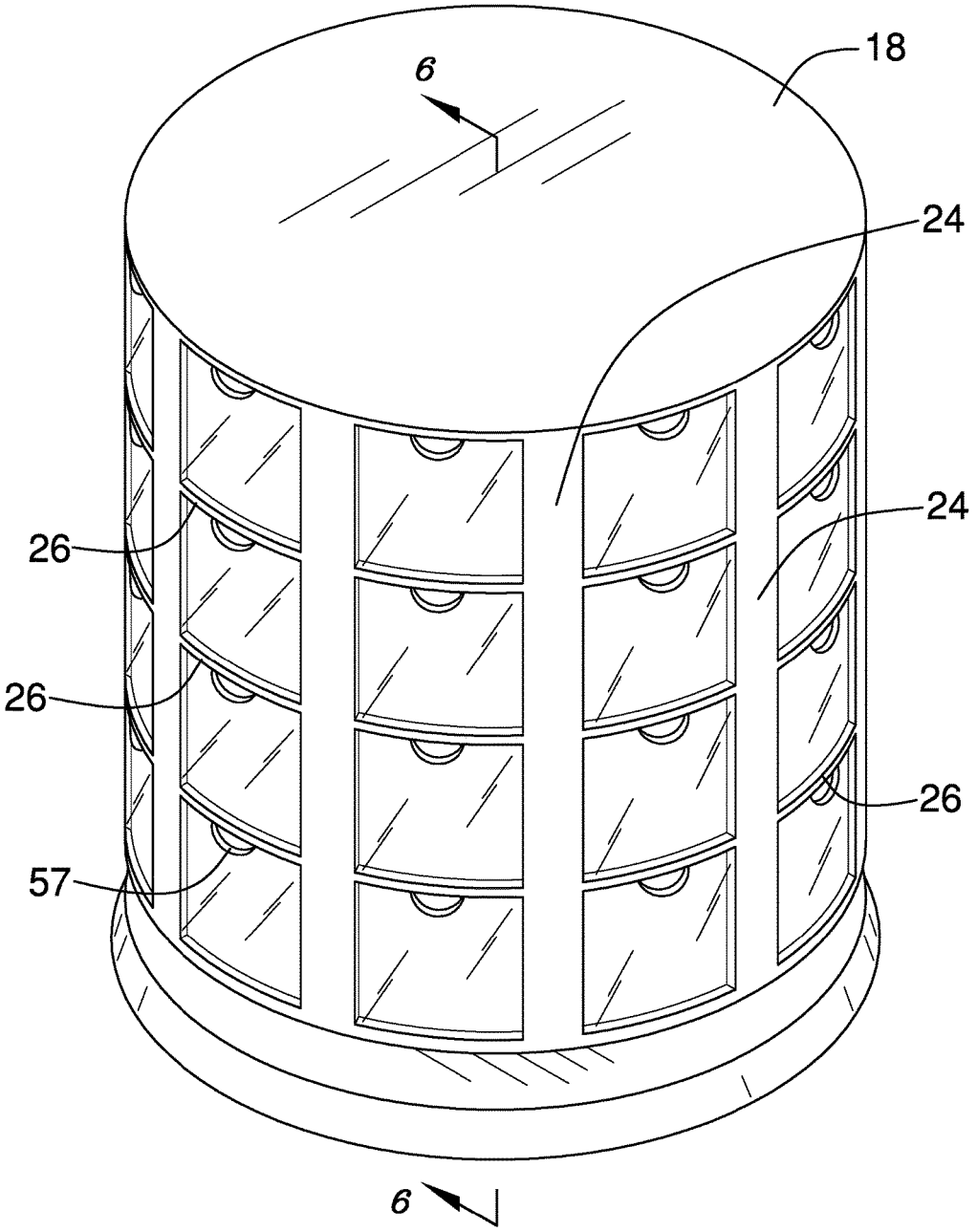
FIG. 5 is a top perspective view of an embodiment of the disclosure.
Figure 6:
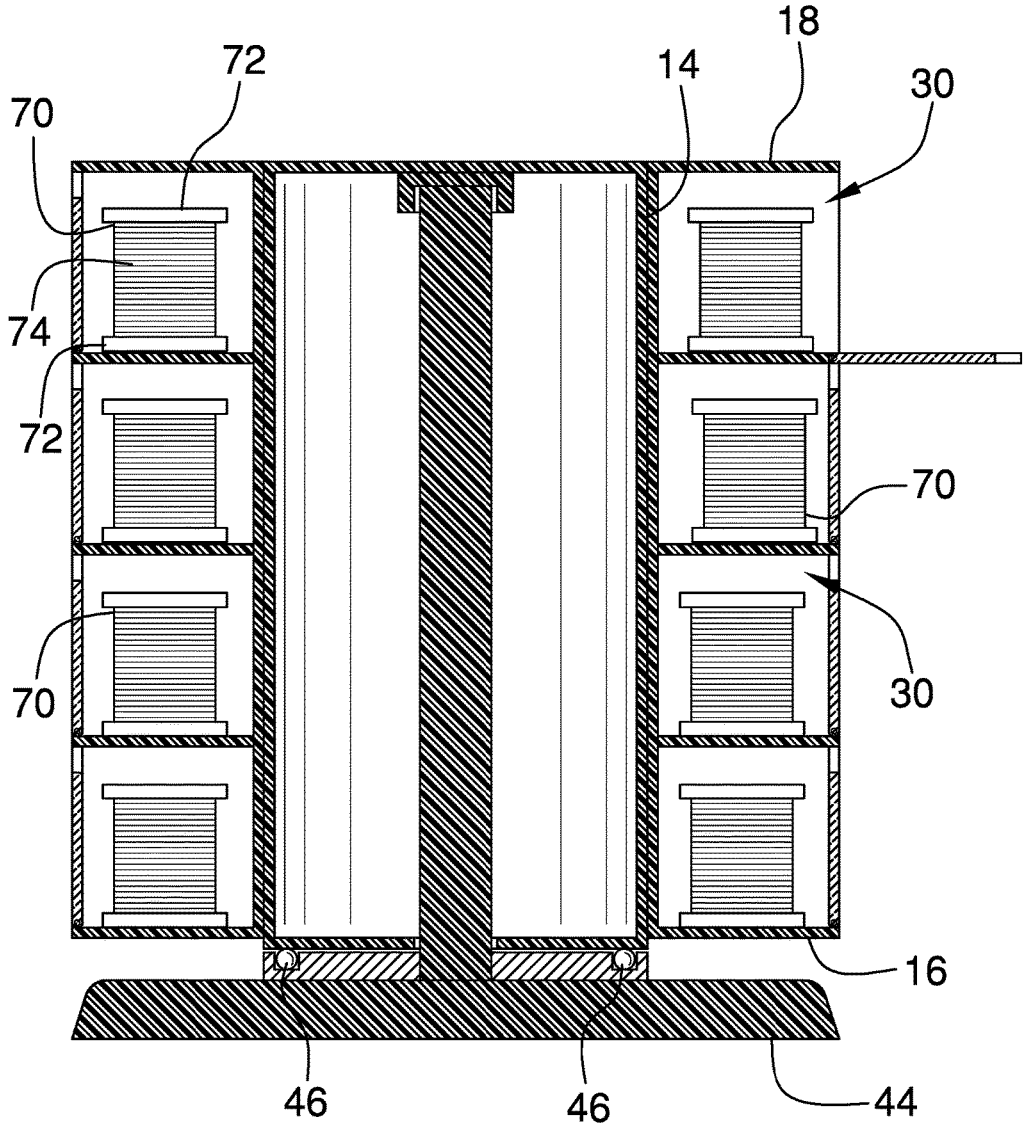
FIG. 6 is a cross-sectional view of an embodiment of the disclosure taken along line 6-6 of FIG. 5.

In an embodiment shown in FIGS. 1-3, the perimeter wall 16 includes a first side wall 40 and a second side wall 42. Each of the horizontal walls 26 extends from the first side wall 40 to the second side wall 42 and the rear wall 14 has a rectangular shape. FIGS. 5 and 6 provide a second embodiment wherein the rear wall 14 forms a cylinder as shown in FIG. 6. This embodiment is rotatably coupled to and extends upwardly from a base 44. For example, bearings 46 may be positioned between the base 44 and the bottom wall 16 to allow the housing 12 to rotate relative to the base 44.

Figure 4:
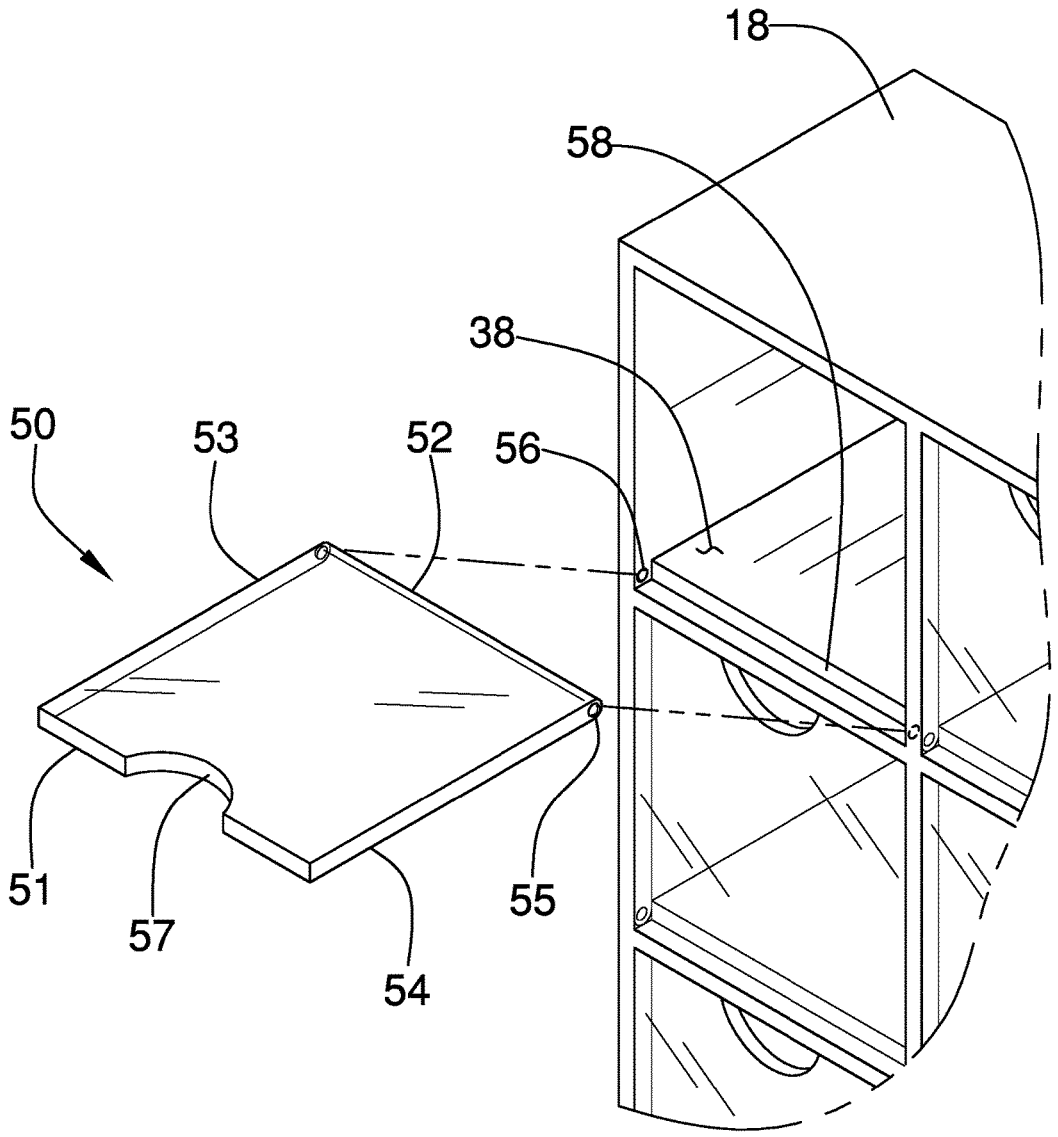
FIG. 4 is a front exploded perspective view of an embodiment of the disclosure.

A plurality of doors 50 is provided and each of the doors 50 has an upper edge 51, a lower edge 52, a first lateral edge 53 and a second lateral edge 54. Each of the compartments 30 has one of the doors 50 is pivotally coupled thereto. The doors 50 each are coupled to an associated one of the compartments 30 adjacent to corresponding ones of the lower edges 52. This may be accomplished in a conventional manner such as with a hinge or pegs may pivotally couple the doors 50 to the vertical 24 or horizontal 26 walls. FIG. 4 includes an embodiment having pegs 55 on the first 53 and second 54 lateral edges adjacent to the lower edge 52 which are extendable into wells 56 in the lateral walls 34 adjacent to the lower wall 38 and more specifically to a forward edge of the lower wall 38. The doors 50 are openable downwardly such that the upper edges 51 pivot downwardly to an open position or upwardly to a closed position. Each of the upper edges 51 has a groove 57 therein configured to be gripped by a person and each of the doors 50 comprising a translucent material.

A plurality of spools 70 of thread is provided and each of the spools is positioned within one of the compartments 30. The compartments 30 each have a size to receive only a single one of the spools 70. The spools 70 each include a pair of end walls 72 wherein both of the end walls 72 are horizontally orientated and one of the end walls 72 is positioned on an associated one of the lower walls 38. Thus the spools 70 each have thread 74 thereon which is wound about a vertical axis orientated perpendicular to the lower walls 38.

In use, the system 10 is utilized to store a plurality of spools 70 of thread in such a manner that the spools 70 are organized and easily identifiable. The doors 50 are translucent to allow light to pass therethrough and may further be transparent to more readily view the color of the thread 72 on each spool 70. The doors 50 are openable in a manner to allow the spools 70 to be easily slid outwardly of the housing 12 without falling out of the compartments 30 and retain the spools 70 within the housing 12 when the doors 50 are closed. The doors 50 may frictionally engage the lateral 34 and upper 36 walls when in a closed position and stops 58 may be utilized that are formed in the lower walls 38 or attached to the lateral and/or upper walls, to prevent the doors 50 from pivoting inwardly of the compartments 30 beyond a vertical orientation.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A thread organization and storages system comprising:

a housing having a rear wall and a perimeter wall being attached to and extending forwardly of said rear wall, said perimeter wall including a top wall and a bottom wall, a front side of said housing being open, a plurality of vertical walls extending between said top and bottom walls, said vertical walls being orientated parallel to each other, a plurality of horizontal walls being attached to said vertical walls, said vertical and horizontal walls forming a plurality of compartments;

each of said compartments having a height between 1.25 inches and 2.5 inches, a width between 1.25 inches and 2.0 inches and a depth between 1.25 inches and 2.0 inches;

a plurality of doors, each of said doors having an upper edge, a lower edge, a first lateral edge and a second lateral edge, each of said compartments having one of said doors being pivotally coupled thereto, said doors each being coupled to an associated one of said compartments adjacent to corresponding ones of said lower edges, said doors being openable downwardly such that said upper edges pivot downwardly to an open position or upwardly to a closed position; and a plurality of spools each having thread thereon, each of said spools being positioned within one of said compartments, said compartments having a size to receive only a single one of said spools.

2. The thread organization and storages system according to claim 1, wherein said perimeter wall includes a first side wall and a second side wall, each of said horizontal walls extending from said first side wall to said second side wall.

3. The thread organization and storages system according to claim 1, wherein said vertical and horizontal walls are each continuously coupled to said rear wall.

4. The thread organization and storages system according to claim 1, wherein said compartments are arranged in columns and rows wherein said rows include at least five rows and said columns includes at least four columns.

5. The thread organization and storages system according to claim 1, wherein each of said upper edges has a groove therein configured to be gripped by a person.

6. The thread organization and storages system according to claim 1, wherein each of said doors comprises a translucent material.

7. A thread organization and storages system comprising:

a housing having a rear wall and a perimeter wall being attached to and extending forwardly of said rear wall, said perimeter wall including a top wall and a bottom wall, a front side of said housing being open, a plurality of vertical walls extending between said top and bottom walls, said vertical walls being orientated parallel to each other, a plurality of horizontal walls being attached to said vertical walls, said vertical and horizontal walls forming a plurality of compartments, each of said compartments including a pair of lateral walls, an upper wall and a lower wall, said perimeter wall including a first side wall and a second side wall, said vertical and horizontal walls are each continuously coupled to said rear wall, each of said horizontal walls extending from said first side wall to said second side wall;

each of said compartments having a height between 1.25 inches and 2.5 inches, a width between 1.25 inches and 2.0 inches and a depth between 1.25 inches and 2.0 inches, said compartments being arranged in columns and rows wherein said rows include at least five rows and said columns includes at least four columns;

a plurality of doors, each of said doors having an upper edge, a lower edge, a first lateral edge and a second lateral edge, each of said compartments having one of said doors being pivotally coupled thereto, said doors each being coupled to an associated one of said compartments adjacent to corresponding ones of said lower edges, said doors being openable downwardly such that said upper edges pivot downwardly to an open position or upwardly to a closed position, each of said upper edges having a groove therein configured to be gripped by a person, each of said doors comprising a translucent material; and a plurality of spools each having thread thereon, each of said spools being positioned within one of said compartments, said compartments having a size to receive only a single one of said spools.

* * * * *